US005180169A

United States Patent [19]

Choy

[11] Patent Number: 5,180,169

[45] Date of Patent: Jan. 19, 1993

[54] GOLF SWING AID

[76] Inventor: Jung-Soo Choy, 4104-A Dunwoody Park, Dunwoody, Ga. 30338

[21] Appl. No.: 875,402

[22] Filed: Apr. 29, 1992

[51] Int. Cl.[5] ..... A63B 69/36

[52] U.S. Cl. ..... 273/189 A; 2/161 A

[58] Field of Search ..... 273/189 A, 189 R, 187.2; 2/161 A, 160, 54 B; 128/879; 434/252

[56] References Cited

U.S. PATENT DOCUMENTS

| | | | |
|---|---|---|---|
| 1,226,160 | 5/1917 | Allis | 273/189 A |
| 1,418,637 | 6/1922 | Flood | 273/189 A |
| 1,469,315 | 10/1923 | Hansard | 273/189 A |
| 2,794,638 | 6/1957 | Risher | 273/54 B |
| 3,235,258 | 2/1966 | Stroburg | 273/54 B |
| 3,350,100 | 10/1967 | Carmines | 273/187.2 |
| 3,606,342 | 9/1971 | Albertson, Jr. | 273/189 R |
| 3,970,305 | 7/1976 | Hawkins | 273/54 B |
| 4,088,318 | 5/1978 | Massman | 273/189 A X |
| 4,677,971 | 7/1987 | Lindemann | 273/54 B X |

*Primary Examiner*—George J. Marlo
*Attorney, Agent, or Firm*—Kennedy & Kennedy

[57] ABSTRACT

A golf swing aid (10) has a glove (11) adapted to be worn on the hand of a golfer closest to the intended target. The golf swing aid includes a hand support member (20) and an arm support member (23) mounted within plies of the glove. The hand support member is coupled to the arm support member by a ball and socket joint (29) which limits the backwards flexing of a golfer's wrist.

10 Claims, 1 Drawing Sheet

GOLF SWING AID

TECHNICAL FIELD

This invention relates to golf swing aids for golfers for use in controlling the flexing of the wrist during play.

BACKGROUND OF THE INVENTION

Golf is a game which requires exacting techniques to achieve a proper swing. A great deal of attention is paid by golfers to the movement of particular parts of the body in performing a golf swing. A departure from ideal body movements may be done so unknowingly, resulting in a deviation from the proper swing which impairs their game. Often, improper body movement occurs in connection with the motion of the wrists.

In golf, as the golf club is drawn backwards the left wrist, of a right handed golfer, is flexed laterally and slightly forwards with respect to the forearm, "forward" meaning the direction in which the fingers would move in clinching a fist. This motion is often referred to as the cocking of the wrists. As the club is next swung forwards the wrist is snapped laterally and backwardly to a backward flexing of the wrist. It is this snapping of the wrist which causes many golfers a great deal of problem. For instance, an overextension or overflexing of the wrist at the moment of impact between the golf club and the golf ball may impart an unwanted side spin on the golf ball, causing it to deviate from a straight path of flight. The same also holds true for an underflexing of the wrist, except that the imparted side spin is in the opposite direction.

Hence, devices have long been devised in attempts to control or restrict the movement of the wrist as a golfer swings a club. An example of such as device is shown in U.S. Pat. No. 1,469,315 which shows a brace designed to extend along the back of a golfer's wrist and an optional brace designed to extend along the front of a golfer's wrist. This type of brace however hampers lateral movement of the wrist and may cause discomfort as the brace rubs against the hand.

Devices for other types of athletic endeavors have also been designed to control the movement of the wrists. For example, U.S. Pat. No. 3,606,342 discloses a wrist control device for both bowlers and golfers which has a hand member mounted to the back of a hand and an arm member mounted to the top of the arm. The hand member and arm member are connected to each other via pivotal means. However, this device allows for only lateral movement of the hand, thereby making it difficult to flex the wrist properly. A variation of the type of the device just described is shown in U.S. Pat. No. 3,970,305. This device has two pivots which allow movement of portions of the device about two axes aligned generally perpendicular to each other. The dual movement this type of device imparts may be quit mechanical and unnatural in feeling to a golfer. Thus, the golfer or bowler may be distracted by this sensation and thereby be unable to concentrate fully on other aspects of his or her swing.

It thus is seen that a need remains for an aid for controlling the movement of a golfer's wrist through a swing in a more natural and effective manner. It is to the provision of such that the present invention is primarily directed.

SUMMARY OF THE INVENTION

In a preferred form of the invention, a golf swing aid comprises a hand support member, a forearm support member and a ball and socket joint coupling the hand support member with the forearm support member to permit articulated movement of the hand support member with respect to the forearm support member. The swing aid further includes mounting means for mounting the hand support member to the back of a golfer's hand and mounting means for mounting the forearm support member to the golfer's forearm. The ball and socket joint is configured to allow greater forward articulated movement of the hand support member with respect to the arm support member than backwards articulated movement of the hand support member with respect to the arm support member thereby limiting backward flexing of the wrist.

DETAILED DESCRIPTION

Figure 1:
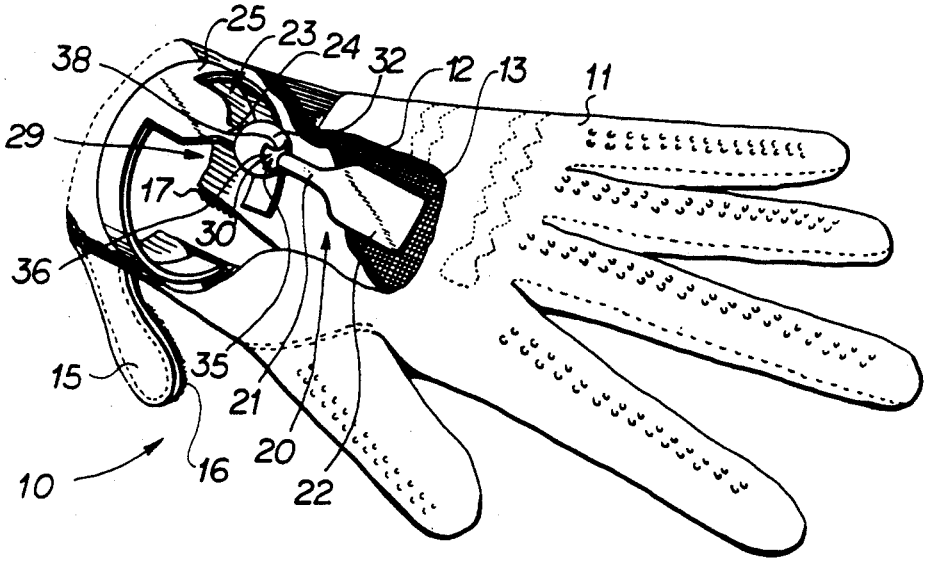
FIG. 1 is a perspective view of a golf swing aid embodying principles of the invention shown with a portion of the aid removed to reveal internal components.

With reference next in detail to the drawing, there is shown a golf swing aid 10 that embodies principles of the invention in a preferred form. The aid 10 has a soft, flexible glove 11 having an outer ply 12 and an inner ply 13. The glove is split adjacent its cuff 14 so as to allow it to be easily donned and secured by a tab 15. The tab 15 bears fibrous fasteners 16 adapted to releasibly mate with fibrous fasteners 17 affixed to the glove cuff 14. The glove is sized to cover the hand, the wrist, and a lower portion of the forearm of a golfer.

The aid is also has a resilient, elongated, hand support member 20 mounted to a mid-portion of the glove between the cuff 14 and the finger portions of the glove. The hand support member 20 is in the general shape of a paddle that has an arm 21 that extends to a flat support portion 22. The aid also has an arm support member 23 mounted to the cuff 14 of the glove. The arm support member 23 has a rigid, elongated arm 24 extending from a resilient, C-shaped clasp 25. The hand support member 20 is coupled to the arm support member 23 by a ball and socket joint 29. The ball and socket joint 29 has a ball 30 mounted to an end of the arm 21 and a socket 32 mounted to an end of the arm 24 of the arm support member 23. The socket 32 is sized and shaped to receive and hold the ball 30 rotatably therein. The socket 32 has an orifice 35, defined by side wall edges 36, through which the arm 21 extends. The socket also has a lobe portion 38 above a top portion of the orifice side wall edges 36. As shown in FIG. 1, the hand support member 20, the arm support member 23, and the ball and socket joint 29 are securely mounted between the outer and inner plies of the glove 11 as by adhesive or by sewing the plies together about these portions of the aid.

In use, a golfer dons the aid 10 by inserting a hand into the glove 11 and fastening the fibrous fasteners 16 and 17 together with the split cuff drawn tight. A right handed golfer places the aid on the left hand for which the glove shown in FIG. 1 is designed. With the glove placed on the hand in this manner, the arm 24 is positioned against the back of the golfer's forearm and the C-shaped clasp 25 extends snugly about the forearm. The hand support member 20 is positioned against the back of the golfer's hand, and the ball and socket joint is positioned over the golfer's wrist with the socket lobe portion 38 located distally from the golfer's hand, as shown in FIG. 1.

Figure 3:
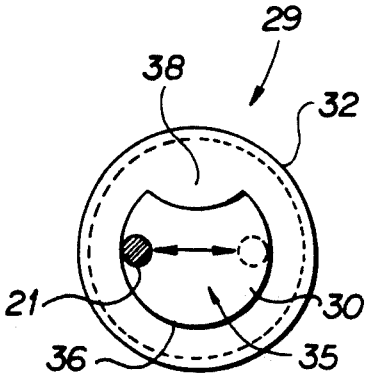
FIG. 3 is a front elevational view of the ball and socket joint of the golf swing aid of FIG. 1.
Figure 4:
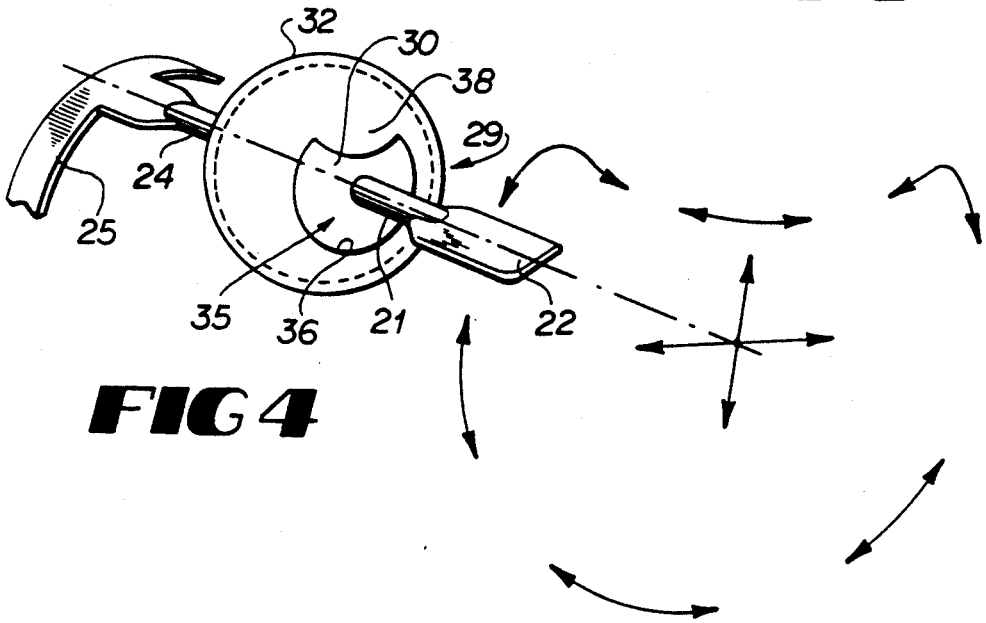
FIG. 4 is a perspective view of the ball and socket joint portion of the golf swing aid of FIG. 1.

The ball and socket joint 29 allows for articulated movement of the hand support member 20 in all rotary directions within the bounds of the orifice 35, as illustrated in FIG. 4. This articulated movement correlates to limited movement of the golfer's hand. As best shown in FIG. 3, the arm 21 of the hand support member may move laterally within the orifice, thereby allowing the golfer's hand to move in a lateral direction with respect to the forearm as cocking and uncocking of the wrist occurs in a golf swing.

Figure 2:
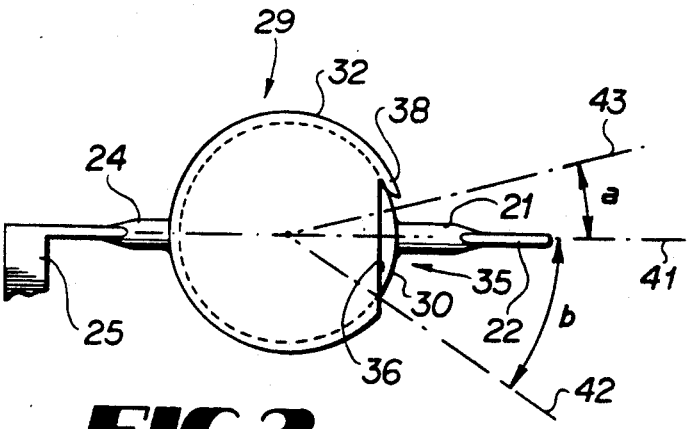
FIG. 2 is a side elevational view of a ball and socket joint of the golf swing aid of FIG. 1.

As best shown in FIG. 2, the ball and socket joint may be aligned in a neutral position with the arm support member 23 and the hand support member 20 axially aligned along an axis 41. A neutral alignment of the arm support member with the hand support member correlates to a golfer's wrist being substantially straight, i.e. neither flexed forwards nor backwards. The arm support member may move downward to a downward-most position represented by phantom line 42. Preferably, the angle b between the neutral position and the downward-most position is 75°, although a somewhat smaller angle would not be detrimental since a golfer's wrist does not usually flex this far during the typical golf swing. The arm support member may also move upward to an upward-most position represented by phantom line 43. The angle a between the neutral position and the upward-most position is preferably about 15°. This serves to limit backward flexing of the golfer's wrist. Flexing beyond this angle is improper as it usually results in the golf ball being imparted with an unwanted side spin, thereby causing it to hook or slice. It should be noted, however, that because of other deviations in the golfer's swing from a proper swing, the lobe portion 38 may be configured to compensate for such deviations by increasing or decreasing angle a. The maximum range of angle a is between 0° and 45°.

With the swing aid secured in place a golfer is able to flex his or her wrist freely in all directions during golf swings with only backward flexing of the wrist being limited. The ball and socket joint produces an articulated movement originating from only one point as opposed to the mechanical movement of prior devices. It is this which imparts a more natural feeling.

It should also be noted that alternatively the ball 30 may be mounted to the arm support member 23 and the socket 32 may be mounted to the hand support member 20.

If desired, the portion of the side wall edges 36 that define lobe portion 38 and the portion of the side wall edges opposite the lobe portion may be configured straight instead of arcuate to allow only lateral movement of the hand support member 20. The lobe portion may also be double curved or S-shaped so as to produce a different amounts of backward movement limitations of the hand support member. Again, these variances in the shape of the lobe portion, and thus the orifice 35, are to compensate for relatively minor flaws in individual golfer's swings.

It thus is seen that a golf aid that controls the flexing of the wrist with a more natural feel and in a more effective manner is now provided. It should be understood however that the just described embodiment merely illustrates principles of the invention in its preferred form. Many modifications, additions and deletions may, in addition to those expressly recited, be made thereto without departure from the spirit and scope of the invention as set forth in the following claims.

I claim:

1. A golf swing aid for use in controlling the flexing of a golfer's wrist during play comprising a hand support member, mounting means for mounting said hand support member to the back of a golfer's hand, a forearm support member, mounting means for mounting said forearm support member to the golfer's forearm, and a ball and socket joint coupling said hand support member with said forearm support member to permit articulated movement of said hand support member with respect to said forearm support member, said ball and socket joint being configured to allow substantially greater forward articulated movement of said hand support member with respect to said arm support member than backward articulated movement of said hand support member with respect to said arm support member.

2. The golf swing aid of claim 1 wherein said ball and socket joint has a ball and a socket sized and shaped to receive said ball, said socket having an orifice defined by socket side wall edges through which one of said support members extends, and wherein the articulated movement of said one support member is limited by said socket side wall edges.

3. The golf swing aid of claim 2 wherein said one support member is said forearm support member.

4. The golf swing aid of claim 2 wherein said one support member is said hand support member.

5. The golf swing aid of claim 1 wherein said forearm support member mounting means comprises a cuff portion of a flexible glove and said hand support member mounting means comprises a mid-portion of a flexible glove.

6. The golf swing aid of claim 5 wherein said glove cuff portion and said glove mid-portion are comprised of two plies of material, and wherein said hand support member and said arm support member are mounted between said plies.

7. The golf swing aid of claim 1 wherein said forearm support member has a C-shaped portion for holding said forearm support member snugly about a golfer's forearm.

8. The golf swing aid of claim 1 wherein said hand support member is paddle shaped.

9. A golf swing aid for use in controlling the flexing of a golfer's wrist during play comprising a glove having a cuff portion at least a portion of which has multiple plies and a mid-portion at least a portion of which has multiple plies;

a hand support member mounted between said plies of said glove mid-portion;

an arm support member mounted between said plies of said glove cuff portion;

coupling means including a ball and socket joint coupling said hand support member and said arm support member to permit articulated movement of said hand support member with respect to said forearm support member; and whereas said ball and socket joint being configured to allow substantially greater forward articulated movement of said hand support member with respect to said arm support member than the backward articulated movement of said hand support member with respect to said arm support member.

10. The golf swing aid of claim 9 wherein said ball and socket joint has a ball and a socket sized and shaped to receive said ball, said socket having an orifice defined by socket side wall edges through which one of said support member extends, and wherein the articulated movement of said one support member is limited by said socket side wall edges.

* * * * *